US009282400B2

(12) United States Patent
Greene, IV et al.

(10) Patent No.: US 9,282,400 B2
(45) Date of Patent: Mar. 8, 2016

(54) PORTABLE ISOLATION CABINET

(71) Applicants: William Greene, IV, St. Joseph, MO (US); C. Trent Canupp, Platte City, MO (US)

(72) Inventors: William Greene, IV, St. Joseph, MO (US); C. Trent Canupp, Platte City, MO (US)

( * ) Notice: Subject to any disclaimer, the term of this patent is extended or adjusted under 35 U.S.C. 154(b) by 149 days.

(21) Appl. No.: 14/194,932

(22) Filed: Mar. 3, 2014

(65) Prior Publication Data

US 2014/0254833 A1 Sep. 11, 2014

Related U.S. Application Data

(60) Provisional application No. 61/772,391, filed on Mar. 4, 2013.

(51) Int. Cl.

| | |
|---|---|
| ***H04R 1/08*** | (2006.01) |
| ***H04R 1/34*** | (2006.01) |
| ***H04R 1/02*** | (2006.01) |

(52) U.S. Cl.

CPC ..... *H04R 1/34* (2013.01); *H04R 1/025* (2013.01); *G10H 2220/211* (2013.01); *H04R 2201/028* (2013.01)

(58) Field of Classification Search

CPC ..... H04R 1/02; H04R 1/08; H04R 9/08; H04R 11/04; H04R 17/02; H04R 21/02; H04R 1/105; H04R 1/025; H04R 1/026

USPC ..... 381/333–334, 355–358, 360, 365, 381/368–369, 388

See application file for complete search history.

(56) References Cited

U.S. PATENT DOCUMENTS 6,697,495 B1 * 2/2004 Youn ..... G06F 1/1616 381/333

* cited by examiner

*Primary Examiner* — Suhan Ni

(74) *Attorney, Agent, or Firm* — David M. Pankros

(57) ABSTRACT

A portable isolation cabinet includes a body with a sidewall, a floor, and a positioning device. The sidewall is located on an edge of the floor. The positioning device is disposed on an interior face of the sidewall for removably securing a combination amplifier. The lid is pivotally connected to the body along one of its edges lid and an edge of the sidewall. The insulation is located on the interior face of the sidewall and is operable to absorb, and prevent reflection of, sound. The body and the lid are operable to close and thereby form an enclosed interior space. A focuser reflects sound emanating from the amplifier and directs it to a microphone.

15 Claims, 3 Drawing Sheets

Fig. 1.
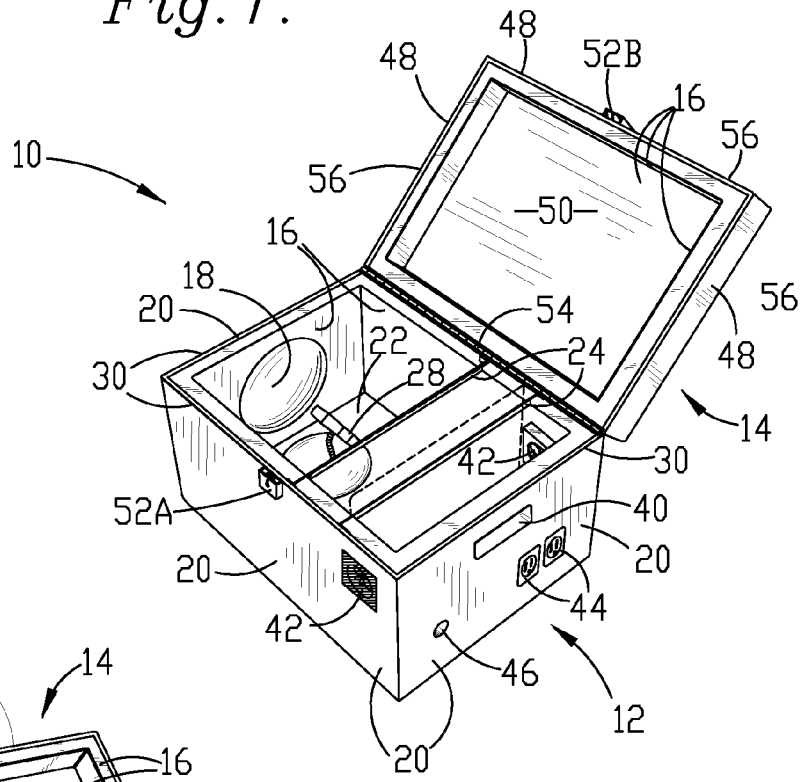
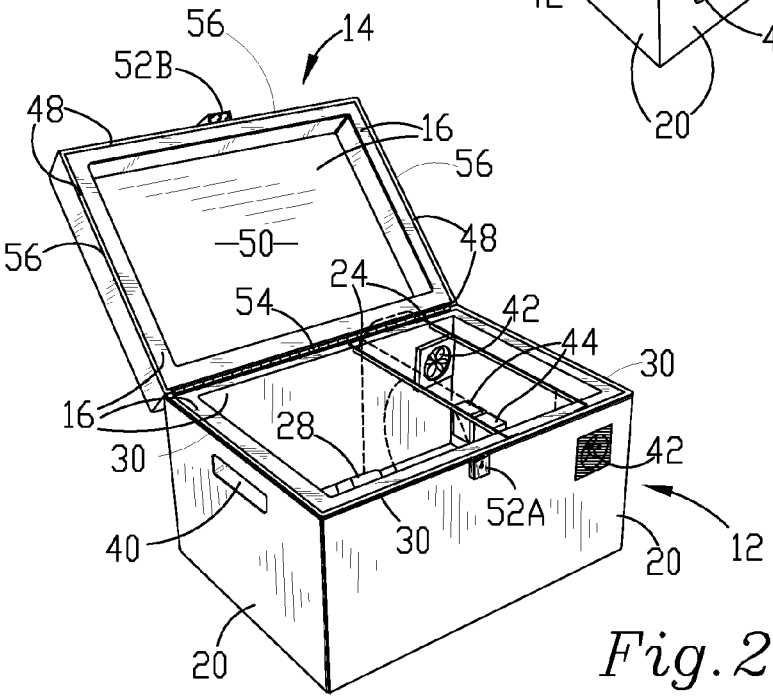
Fig. 2.

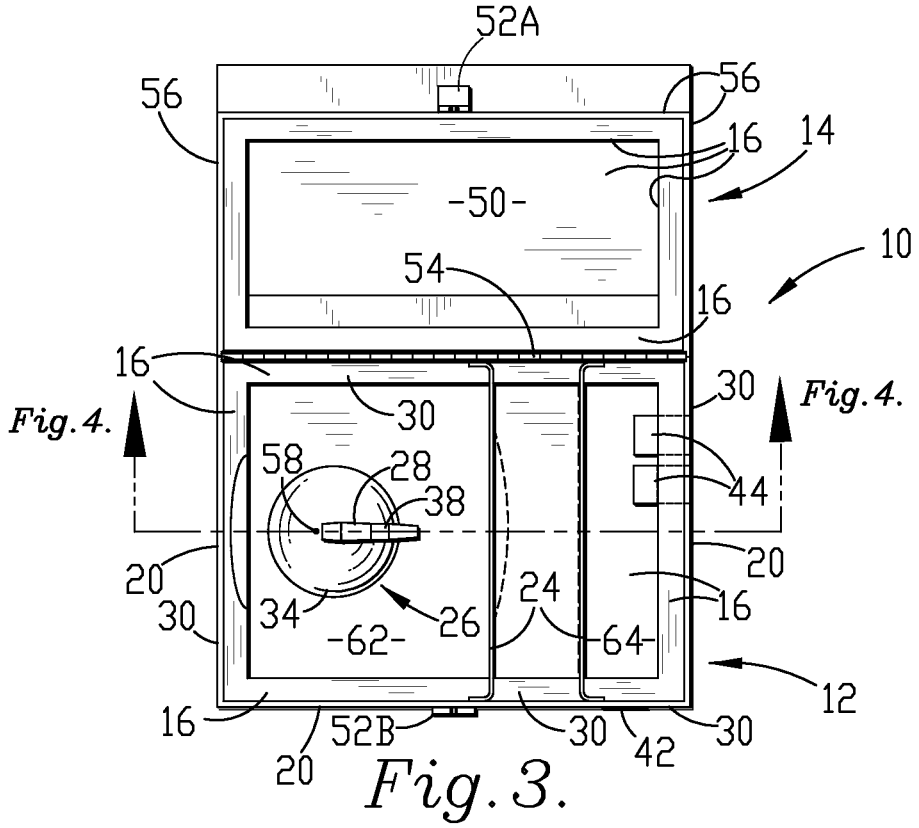
Fig. 3.
Fig. 4.
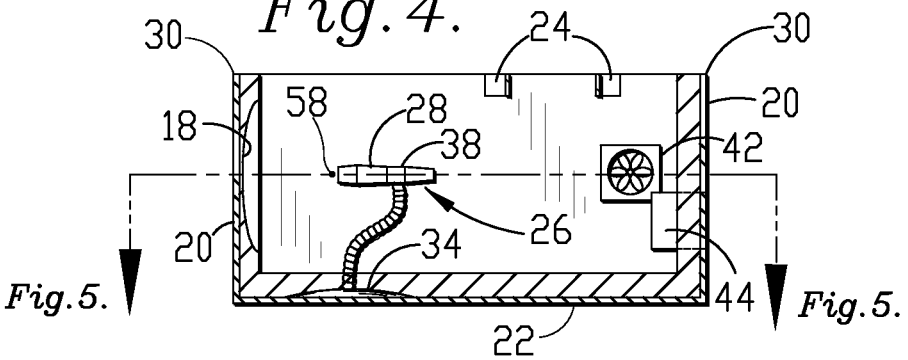
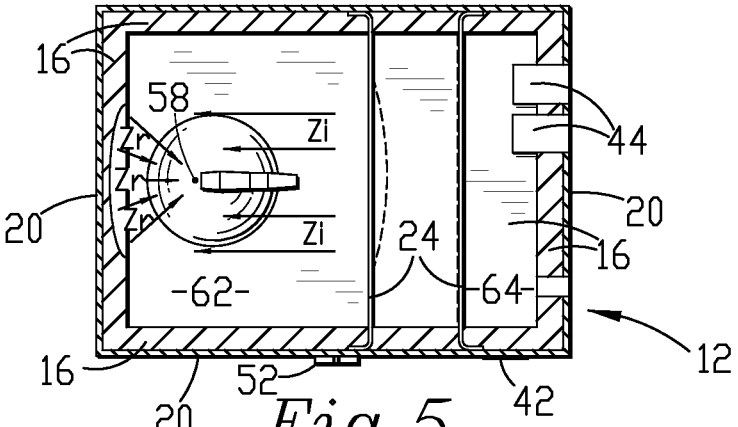
Fig. 5.

PORTABLE ISOLATION CABINET

RELATED APPLICATIONS

This application claims the benefit of U.S. Provisional Application No. 61/772,391, filed 4 Mar. 2013 that is incorporated by specific reference in its entirety herein.

FIELD OF THE INVENTION

This present invention relates to amplifiers for musical instruments. More particularly, the invention relates to portable isolation cabinets for combination amplifiers.

BACKGROUND

To accurately record the natural sound of guitar tracks, musicians typically use a microphone to capture the sound emitted from a combination amplifier. While this technique provides accurate sound, it can also cause a feedback loop if done near the sound source or it can capture accompanying instruments or unwanted background noise. To solve this difficulty, portable isolation cabinets allow a microphone and combination amplifier to be used to capture the natural sound of the guitar while avoiding feedback loops, the sound of accompanying instruments, and background noise. This, in turn allows recording to be performed at lower volume levels that reduces distortion.

While prior art isolation cabinets can reduce background volume levels, they do not capture all the sound emitted from the combination amplifier because they only capture sounds emitted directly at a microphone. Sound that is off-axis will be directed into sound-absorbing insulation and will not be captured by the microphone.

Additionally, prior art isolation cabinets attach to the front of a combination amplifier and, thus, can allow sound or noise to be transferred though the combination amplifier body. Thus, in turn, can create distortion or, in severe cases, a feedback loop.

SUMMARY

The present invention solves the above-described problems and provides a distinct advance in the art of portable isolation cabinets. The problem of capturing the full and true sound emanating from the speaker of a combination amplifier is solved by using a parabolic reflector axially aligned with the speaker of the combination amplifier and positioning the active end of a microphone at the focal point of the reflector. The problem of eliminating excess outside noise is solved by enclosing the combination amplifier within an enclosed, sealed and insulated cabinet that forms two separate and acoustically distinct interior spaces.

In a first embodiment, the portable isolation cabinet includes a body, a lid, insulation, and a focuser. The body is a box with an open side. The positioning device positions a combination amplifier within the interior space of the body. The microphone stand is positioned on the floor of the body for positioning the microphone within the interior space of the body. The body may further include handles on an exterior face of the body. A fan may also be used to reduce heat within the interior space of the body.

The lid closes the open side of the body and prevents noise from entering and containing the contents of the body. The lid may include a securing mechanism to removably fix the lid in a closed position.

The insulation is disposed on the interior faces of the sidewalls, the floor, and the top to reduce vibrations and sound on the inside of the cabinet from outside the isolation cabinet.

The focuser reflects sound to a point for collection by an active portion of the microphone and is positioned on an interior face one of the sidewalls of the body. The focuser may be metal and may be parabolic.

In use, the lid of the portable isolation cabinet is opened to reveal the interior space. A combination amplifier having a speaker is placed within the body and is secured in place with the speaker of the combination amplifier facing and generally axially aligned with the focuser. The microphone stand is adjusted so that an active portion of the microphone is at or near the focal point of the focuser. The lid is closed and the insulation engages with the sides of the combination amplifier to create, in effect, two separate chambers within the portable isolation cabinet. One chamber contains the speaker of the combination amplifier, the microphone, and the focuser. In this way, the portable isolation cabinet acoustically seals noise from the outside environment.

In another embodiment, the portable isolation cabinet includes a body, a lid, insulation, and a focuser.

In this embodiment, the body, is generally a cylindrical and has an open longitudinal end. The lid closes the open longitudinal end for preventing noise from entering and for containing the contents of the portable isolation cabinet therein.

In use, this embodiment of a portable isolation cabinet may be used in a way substantially similar to previous embodiment, but this embodiment does not utilize hinges. Instead, this embodiment utilizes a plurality of securing devices to removably secure the lid in place.

This summary is provided to introduce a selection of concepts in a simplified form that are further described below in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present technology are described in detail below with reference to the attached drawing figures, wherein:

FIG. 1 is a perspective view of a portable isolation cabinet constructed in accordance with a first embodiment of the invention;

FIG. 2 is a perspective view of the portable isolation cabinet of FIG. 1;

FIG. 3 is a top elevational view of the portable isolation cabinet of FIGS. 1-2;

FIG. 4 is a cutaway view of the body of the portable isolation cabinet of FIGS. 1-3, as seen through the line indicated in FIG. 3;

FIG. 5 is a cutaway view of the body of the portable isolation cabinet of FIGS. 1-4, as seen through the line indicated in FIG. 4.

Figure 6:
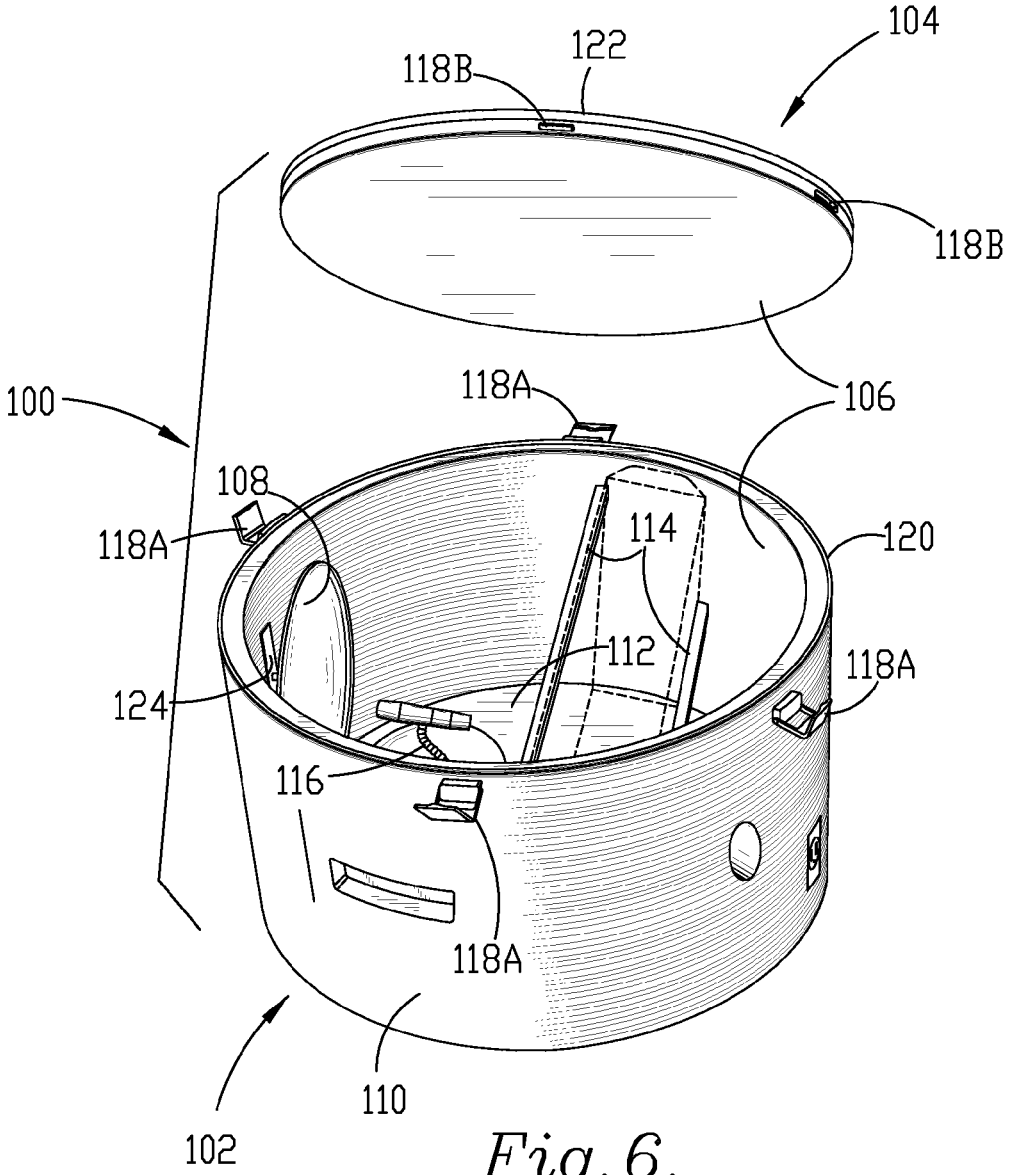
FIG. 6 is a perspective view of a portable isolation cabinet constructed in accordance with a second embodiment of the invention.

The drawing figures do not limit the present invention to the specific embodiments disclosed and described herein. The drawings are not necessarily to scale, emphasis instead being placed upon clearly illustrating the principles of the technology.

DETAILED DESCRIPTION

The following detailed description of various embodiments of the present technology references the accompanying drawings which illustrate specific embodiments in which the technology can be practiced. The embodiments are intended to describe aspects of the technology in sufficient detail to enable those skilled in the art to practice them. Other embodiments can be utilized and changes can be made without departing from the scope of the technology. The following detailed description is, therefore, not to be taken in a limiting sense. The scope of the present technology is defined only by the appended claims, along with the full scope of equivalents to which such claims are entitled.

Note that in this description, references to "one embodiment" or "an embodiment" mean that the feature being referred to is included in at least one embodiment of the present invention. Further, separate references to "one embodiment" or "an embodiment" in this description do not necessarily refer to the same embodiment; however, such embodiments are also not mutually exclusive unless so stated, and except as will be readily apparent to those skilled in the art from the description. For example, a feature, structure, act, etc. described in one embodiment may also be included in other embodiments. Thus, the present invention can include a variety of combinations and/or integrations of the embodiments described herein.

Turning now to the drawing figures and, in particular FIGS. 1-4, a Portable isolation cabinet 10 for a combination amplifier broadly includes a body 12, a lid 14, insulation 16, and a focuser 18.

In this embodiment, the body 12 is a box with an open side for insulating and containing the insulation 16, and the focuser 18, and further includes a plurality of sidewalls 20, a floor 22, a positioning device 24, a microphone stand 26, a microphone 28, and when in use, a combination amplifier. The sidewalls 20 are upstanding, generally planar, and arranged end-to-end around the peripheral edge of the floor 22. The floor 22 has a plurality of edges at which an edge of each of the plurality of sidewalls 20 is disposed thereon. Thus, the sidewalls 20 and the floor 22 form an open box. Most commonly four sidewalls will be used and, thus, the body 12 will be a rectangular solid with an open edge 30. In other embodiments, however, five, six, eight, or any other number of sidewalls may be used and the body 12 will be pentagonal solid, hexagonal solid, octagonal solid, or the like, each with an open edge 30. In some embodiments, the plurality of sidewalls 20 may be replaced with one cylindrical or otherwise curved sidewall. In that embodiment, the floor 22 will, correspondingly, have an edge with a curved profile at which the edge of the curved sidewall will be disposed. Various other configurations are possible, as well. The positioning device 24 removably disposes a combination amplifier within an interior space of the body 12. In this embodiment, the amplifier positioning device 24 is an elongated rod disposed between two of the plurality of sidewalls 20. The body 12 may also include a securing mechanism 52A, as described in more detail below.

The microphone stand 26 is fixedly disposed on the floor 22 of the body 12 for positioning the microphone 28 within the interior space of the body 12, as described in more detail below. In this embodiment, the microphone stand 26 has a base 34, a neck 36, and a microphone coupler 38. In other embodiments, other varieties of microphone stands may be used. The microphone 28 is a conventional unidirectional condenser microphone disposed within the microphone coupler 38. In other embodiments, omnidirectional microphones may be used. In yet other embodiments, a ribbon microphone, or shotgun microphone may also be used.

In some embodiments, the body may further include handles 40 on an exterior face of the plurality of sidewalls 20, a fan 42 to reduce heat within the interior space of the body 12, electrical connections 44, and various cutouts 46 to allow cables to be routed from a combination amplifier to various equipment or instruments.

The lid 14 closes the open side of the body 12 for preventing noise from entering and containing the contents therein and, in this embodiment, further includes a plurality of sidewalls 48, a top 50, a securing mechanism 52B, and, in some embodiments, a hinge 54. The plurality of sidewalls 48 of the lid 14 correspond in number and configuration to the plurality of sidewalls 20 of the body 12. Thus, most commonly four sidewalls will be used and, thus, the lid 14 will be a rectangular solid with an open edge 56. The plurality of sidewalls 48 are generally planar and are arranged end-to-end in a generally rectangular pattern. Similar to the body 12, the top 50 includes a peripheral edge at which an edge of each of the plurality of sidewalls 48 is disposed thereon. The securing mechanism 52B removably fixes the lid in a position so that each of the plurality of sidewalls 48 of the lid 14 is aligned with each of the plurality of sidewalls 20 of the body 12. In this way, the securing mechanism 52 allows the body 12 and the lid 14 to form an enclosed interior space. In this embodiment, the securing mechanism 52A, 52B is a latch. In some embodiments, a hinge 54 may be used to pivotally connect the lid 14 to the body 12. In embodiments where a hinge 54 is used, one side of the hinge 54 is generally disposed along the open edge 56 one of the plurality of sidewalls 48 of the lid 14 and the other side of the hinge 54 is disposed along the open edge 30 of one of the plurality of sidewalls 20 of the body 12. Thus, the hinge 54 assists in aligning the lid 14 and the body 12 and acts, in conjunction with the securing mechanism 52A, 52B to fix the lid 14 in position so that each of the plurality of sidewalls 48 of the lid 14 is aligned with each of the plurality of sidewalls 20 of the body 12, the open edge 30 being proximal to the open edge 56. In some embodiments, a tongue and groove arrangement may be used wherein the open edge 30 further includes a tongue and the open edge 56 further includes a groove, or vice versa. In other embodiments, the plurality of sidewalls 48 may be omitted and the peripheral edge of the top 50 is aligned with each of the plurality of sidewalls 20 of the body 12 to form an enclosed interior space.

The insulation 16 is disposed on the interior faces of the sidewalls 20, the sidewalls 48, the floor 22, and the top 50 to reduce vibrations and sound on the inside of the cabinet from outside the isolation cabinet. In this embodiment, the insulation is dense closed-cell foam of 2.54 cm (1 in) to 5.08 cm (2 in) in thickness. Prior art devices use, in contrast, fiberglass batting, or pressed fiberglass. In other embodiments, different materials and different thicknesses of materials may be used depending on the configuration of the cabinet and the interior space contained therein.

The focuser 18 reflects sound to a point or an area for collection by the microphone 28 and is disposed on an interior face one of the plurality of sidewalls 20 of the body 12. In this embodiment, the focuser 18 is a metallic parabolic reflector approximately 30.48 cm (12 in) in diameter and with a focal point 58 approximately 12.7 cm to 17.78 cm (5 in to 7 in) from a lateral edge 60 of the focuser 18. In other embodiments, the focuser 18 may be disposed on a support structure that is disposed on one or more of the plurality of sidewalls 20, or the like.

In use, the lid 14 of the portable isolation cabinet 10 is opened to reveal the interior space of the body 12 and the lid 14. A combination amplifier having a speaker is placed within the body 12 and is removably secured in place by the positioning device 24 with the speaker of the combination amplifier facing the focuser 18 and generally axially aligned with therewith. The microphone stand 26 is adjusted so that an active portion of the microphone 28 is at or near the focal point 58 of the focuser 18. The lid 14 is closed, the securing mechanism 52 locked, and the insulation 16 engages with the sides of the combination amplifier to create, in effect, two separate chambers within the portable isolation cabinet 10. The first chamber 62 contains the speaker of the combination amplifier, the microphone 28, and the focuser 18. The second chamber 64 contains primarily electrical cables for providing power to for providing electrical music signals to the combination amplifier and from the microphone. In this way, the first chamber 62 is acoustically sealed from the outside environment and from the second chamber 64 to reduce noises other than those emitted from the combination amplifier speaker.

Turning now in particular to FIG. 5, when the instrument electrically connected to the combination amplifier is played, the combination amplifier emits sound from its speaker toward the focuser 18, as indicated by the arrows Zi. The focuser 18, in turn, reflects the sound back toward the focal point 58, as indicated by arrows Zr. In embodiments such as that sown in FIGS. 1-5 where the focuser 18 is a parabolic, a majority of the sound is reflected precisely to the focal point 58, including sound that is projected lateral to the microphone 28. In this way, the focuser 18 enables the microphone 28 to receive a larger portion of the sounds emitted by the speaker and, in turn, the microphone 28 captures a truer, fuller sound than prior-art devices. If adjustments are required to the combination amplifier, the lid 14 can be easily opened by unlocking the securing mechanism 52. Adjustments may be made, and then the lid 14 closed and the securing mechanism 52 locked again.

Turning out to FIG. 6, another embodiment of a portable isolation cabinet 100 is shown. This embodiment is generally similar to the embodiment shown with reference to FIGS. 1-5, except as illustrated. In this embodiment, the portable isolation cabinet 100 broadly comprises a body 102, a lid 104, insulation 106, and a focuser 108.

In this embodiment, the body 102, is generally a cylinder having an open longitudinal end for insulating and containing the insulation 106, and the focuser 108. The body 102 includes a sidewall 110, a floor 112, a positioning device 114, and a microphone stand 116. The floor 112 is generally circular, though an elliptical profile is envisioned. The sidewall 110 is upstanding and extends from the peripheral edge of the floor 112 at its first edge 114 and further includes a plurality of securing devices 118A. The second edge 120 of the sidewall 110 bounds the periphery of the longitudinal end of the body 102. Thus, the sidewall and floor form an open cylinder.

The lid 104 closes the open side of the body 102 for preventing noise from entering and for containing the contents of the portable isolation cabinet therein. In this embodiments, the lid 104 comprises a top 122 and a plurality of securing devices 118B that are each operable to mate with a corresponding one of the securing devices 118A. The lid 104 is matches the size and shape of the second edge 120 of the body 102 to cover and seal against it.

In this embodiment, the focuser 108 is disposed on a support arm 124.

In use, this embodiment of a portable isolation cabinet may be used in a way substantially similar to that described with reference to FIGS. 1-5. In contrast, however, this embodiment does not utilize hinges. Thus, the lid 104 may be placed atop the second edge 120 of the body 102. The securing devices 118A are aligned with the securing device 118B and each is removably connected to its corresponding mate. Thus, the securing devices 118A, 118B are operable to secure the lid 104 in place and prevent sound from entering an interior space of the portable isolation cabinet 100.

Although the invention has been described with reference to the preferred embodiment illustrated in the attached drawing figures, it is noted that equivalents may be employed and substitutions made herein without departing from the scope of the invention as recited in the claims.

What is claimed is:

1. A portable isolation cabinet comprising:

a body having an upstanding sidewall, a floor, and a positioning device, the upstanding sidewall disposed on an edge of the floor and including a first securing mechanism, the positioning device disposed on an interior face of the upstanding sidewall;

a lid pivotally connected to the body along an edge of the lid and an edge of the sidewall, the lid having a second securing mechanism operable to removably connect with the first securing mechanism;

insulation disposed on the interior face of the upstanding sidewall of the body and operable to absorb, and prevent reflection of, sound;

a support arm disposed on an interior face of the body; and a focuser disposed on the support arm and operable to direct sound at a focal point wherein the body and the lid are operable to close and thereby form an enclosed interior space.

2. The portable isolation cabinet of claim 1 further comprising:

a microphone stand disposed on the body and operable to removably connect to a microphone and position an active end of the microphone at the focal point.

3. The portable isolation cabinet of claim 1, wherein:

the focuser has a generally parabolic shape.

4. The portable isolation cabinet of claim 1, wherein:

the focuser is fabricated from metal and is generally 30.48 cm in diameter.

5. The portable isolation cabinet of claim 1, wherein the lid further comprises:

a sidewall operable to align with the upstanding sidewall of the body.

6. The portable isolation cabinet of claim 1, wherein:

the floor is generally rectangular, and the body comprises four upstanding sidewalls wherein each sidewall is generally rectangular, a bottom edge of each sidewall is disposed on an edge of the floor, and each lateral edge is disposed on a corresponding lateral edge of an adjacent sidewall.

7. A portable isolation cabinet comprising:

a body having an upstanding sidewall, a floor, and a positioning device, the upstanding sidewall having a first and second edge, the sidewall disposed on a peripheral edge of the floor along the first edge and including a first securing mechanism, the positioning device disposed on an interior face of the upstanding sidewall;

a lid operable to mate with the body along the second edge of the sidewall, the lid having a second securing mechanism operable to removably connect with the first securing mechanism and thereby fix the lid in a closed position;

insulation disposed on the interior face of the upstanding sidewall of the body and operable to absorb, and prevent reflection of, sound; and a focuser disposed on an interior face of the upstanding sidewall of the body and operable to direct sound at a focal point;

wherein the body and the lid are operable to close and thereby form an enclosed interior space.

8. The portable isolation cabinet of claim 7 further comprising:

a microphone stand disposed on the body and operable to removably connect to a microphone and position a receiving end of the microphone at the focal point.

9. The portable isolation cabinet of claim 7, wherein:

the focuser has a generally parabolic shape.

10. The portable isolation cabinet of claim 7, wherein:

the focuser is fabricated from metal and is generally 30.48 cm in diameter.

11. The portable isolation cabinet of claim 7, wherein the lid further comprises:

a sidewall operable to align with the upstanding sidewall of the body.

12. A portable isolation cabinet comprising:

a body having four upstanding sidewalls, a floor, a positioning device, and a microphone stand, a bottom edge of each upstanding sidewall disposed on an edge of the floor and each lateral edge of each upstanding sidewall disposed on a corresponding lateral edge of the adjacent sidewalls, a sidewall including a first securing mechanism, and the positioning device disposed on an interior face of the upstanding sidewall;

a lid comprising a top and four sidewalls, the lid pivotally connected to the body along an edge of one of the sidewalls of the lid and an edge of one of the sidewalls of the body, the lid having a second securing mechanism operable to removably connect with the first securing mechanism;

insulation disposed on the interior face of the upstanding sidewall of the body and operable to absorb, and prevent reflection of, sound; and a focuser disposed on an interior face of the upstanding sidewall of the body and operable to direct sound at a focal point;

wherein the body and the lid are operable to close and thereby form an enclosed interior space.

13. The portable isolation cabinet of claim 12, wherein the insulation is closed cell foam.

14. The portable isolation cabinet of claim 12 wherein the microphone stand further comprises:

a base disposed on an interior face of the body, a microphone coupler for removably securing a microphone to the microphone stand, and a neck for movably securing the base to the microphone coupler.

15. The portable isolation cabinet of claim 12 further comprising:

a microphone disposed on the microphone coupler including a body and a receiving end, the receiving end operable to detect and receive sound, the microphone coupler operable to position the receiving end of the microphone at the focal point.

* * * * *